United States Patent [19]

Pezzolato

[11] Patent Number: 4,801,238

[45] Date of Patent: Jan. 31, 1989

[54] VEHICLE FOR THE REMOTE HANDLING OF LOADS

[75] Inventor: Riccardo Pezzolato, Envie, Italy

[73] Assignees: Pezzelato Officine Construzioni Mecchaniche S.p.A., Enrie, Italy; Automated Container Loading Limited, Whitchich, Great Britain

[21] Appl. No.: 73,029

[22] Filed: Jul. 14, 1987

[30] Foreign Application Priority Data

Jul. 15, 1986 [IT] Italy ..... 53631/86[U]

[51] Int. Cl.[4] ..... B66F 9/06

[52] U.S. Cl. ..... 414/607; 280/43.12; 414/608

[58] Field of Search ..... 414/607, 608, 917; 280/43.12; 254/10 R, 10 B, 10 C

[56] References Cited

U.S. PATENT DOCUMENTS 4,103,795 8/1978 Miller ..... 414/608
4,252,495 2/1981 Cook ..... 414/608

FOREIGN PATENT DOCUMENTS 1054432 12/1975 Italy .
1429785 3/1976 United Kingdom .
1453387 10/1976 United Kingdom .

*Primary Examiner*—Robert J. Spar
*Assistant Examiner*—Gary Cundiff
*Attorney, Agent, or Firm*—Pennie & Edmonds

[57] ABSTRACT

A vehicle for the remote handling of loads, comprising a carrying structure (11) with a driving and steering wheel (32), and a fork structure (2) supported by the carrying structure so that it can be raised and lowered and provided with a hook (5) for connection to a vertically-movable attachment part(S) of a lift truck (C). The support structure has a simplified articulated-parallelogram conformation (11) connected to a rear frame (10) of the fork structure (2) and vertical movement of the latter is controlled by a single hydraulic linear actuator (36) vertically interposed between the rear frame (10) and the parallelogram structure (11).

9 Claims, 4 Drawing Sheets

Figure 1:
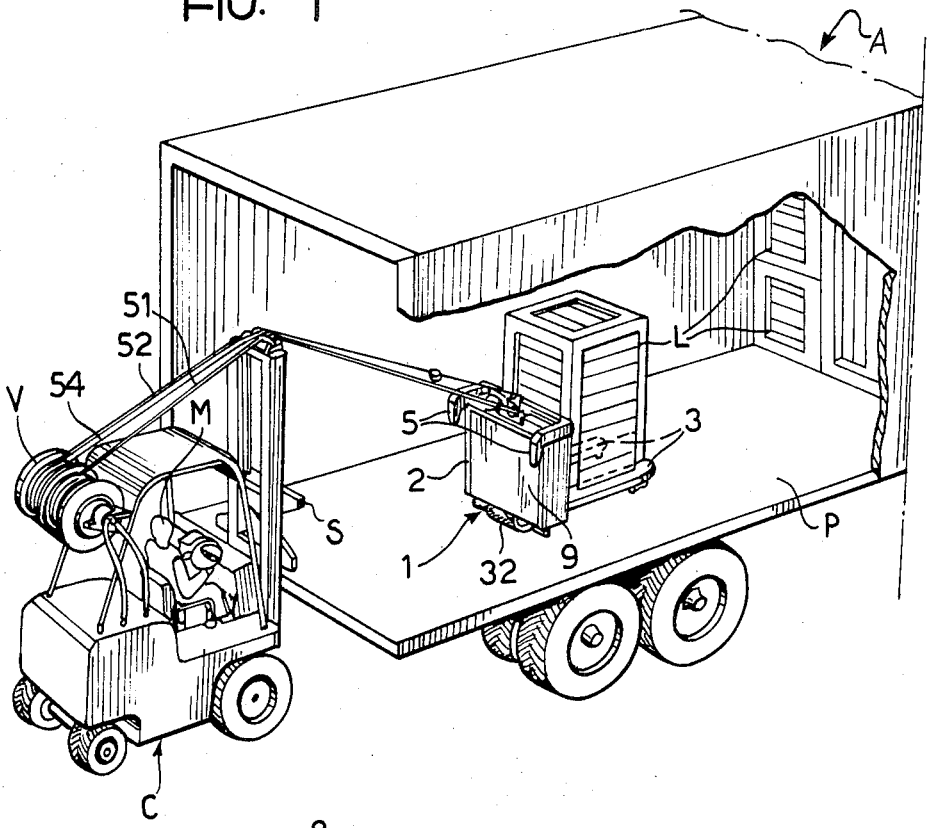

VII
VII

VEHICLE FOR THE REMOTE HANDLING OF LOADS

DESCRIPTION

The present invention refers in general to vehicles for the remote handling of loads.

More particularly, the invention relates to a vehicle comprising a carrying structure provided with a roller-like driving and steering wheel and a fork structure supported by the carrying structure so that it can be raised and lowered, in which the fork structure is provided with hook means for connection to a vertically movable attachment part of a lift truck, and in which electro-hydraulic control means, connected by flexible hoses to the lift truck, are provided for operating the driving and steering wheel and the fork structure.

A vehicle for the remote handling of loads of the type defined above is described and illustrted in Italian Pat. No. 1 054 432 and in the corresponding British Pat. No. 1 453 387. In particular, this vehicle allows the operations of loading and unloading of packages relative to the load platform of a lorry to be made easier and more convenient, since such operations can be carried out by the operator of the lift truck from outside the lorry itself.

The vehicle according to these prior documents has the disadvantage of having a complex, expensive, and heavy structure. In fact, in this vehicle, the support structure consists of a heavy framework provided with lateral rollers movable within suitable lateral guides formed on the sides of the rear part of the fork structure. As well as constructional difficulties, this conformation requires long and complicated manual assembly operations. The electro-hydraulic control devices and the steering system for the driving wheel of this known vehicle are also constructionally complicated.

The object of the present invention is to improve the known vehicle specified above, by simplifying its structural parts and their assembly drastically, while appreciably reducing the weight of the vehicle to the benefit of its usable carrying capacity.

According to the invention, this object is achieved by virtue of the fact that the support structure of the vehicle comprises an articulated parallelogram structure including a bar whose ends are articulated to a rear frame of the fork structure, two vertical legs arranged on opposite sides of the driving wheel and carrying balancing support wheels at their lower ends, a pair of upper arms carried by the horizontal bar and articulated to the tops of the two vertical legs, and a pair of lower arms articulated at one end to the vertical legs and at the other to the rear frame of the fork structure, and in that the tops of the vertical legs are interconnected by a cross member parallel to the horizontal bar and carrying the driving wheel underneath it, a single vertical linear hydraulic actuator for raising and lowering the fork structure relative to the carrying structure being interposed between the middle region of the cross member and the rear frame of the fork structure.

This conformation is notably simpler than that known from the afore-mentioned prior documents, in that it eliminates the use of rollers and associated rolling guides and drastically reduces the number of components of the vehicle.

This simplification allows, among other things, the use of mechanised assembly technology and appreciably reduces the total weight of the vehicle.

According to another characteristic of the invention there is fixed to the cross member of the parallelogram structure a horizontal linear hydraulic actuator with a movable cylinder to the lower end of which is fixed a plate bearing a vertical pulling pin offset with respect to the actuator for rotation of a forked support articulated to the cross member and carrying the driving wheel.

The driving wheel is driven by a rotary hydraulic actuator incorporated therein.

Figure 4:
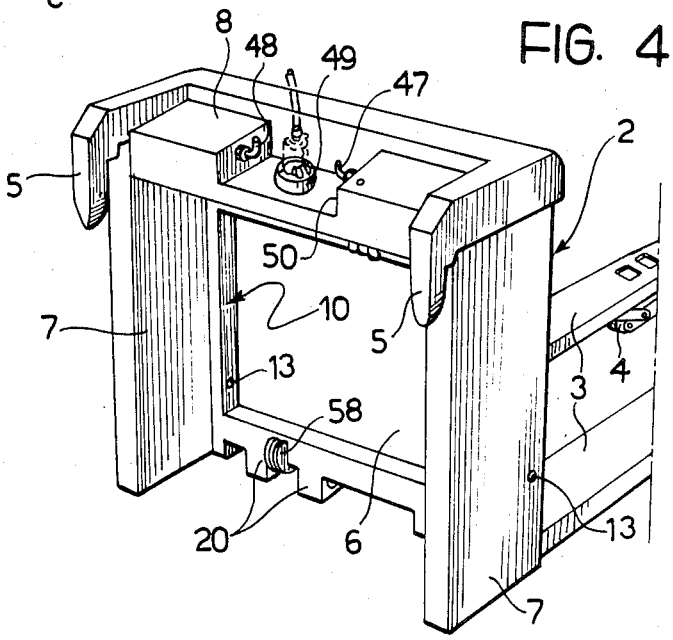
Figures 2, 6, 7:
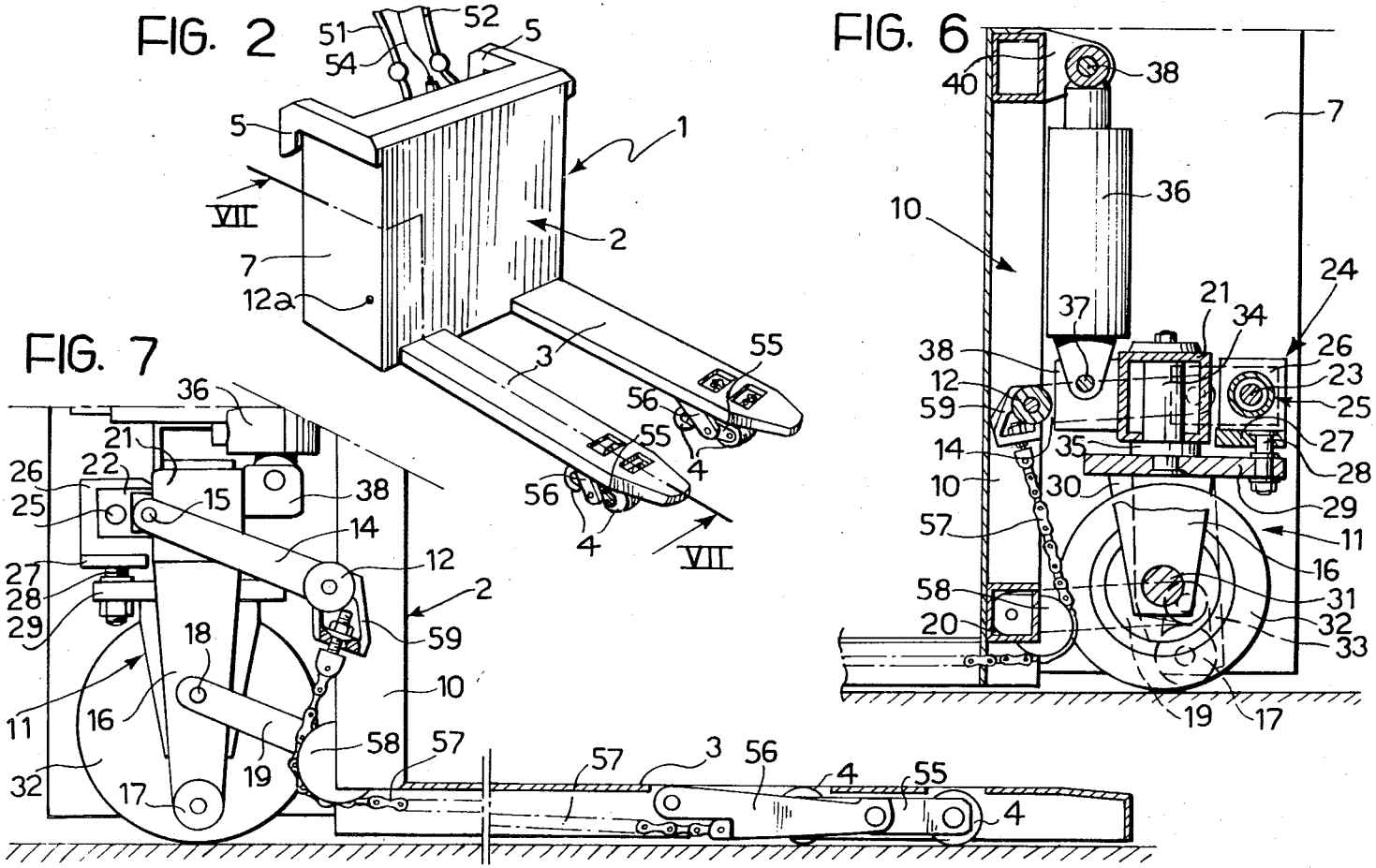
Figure 3:
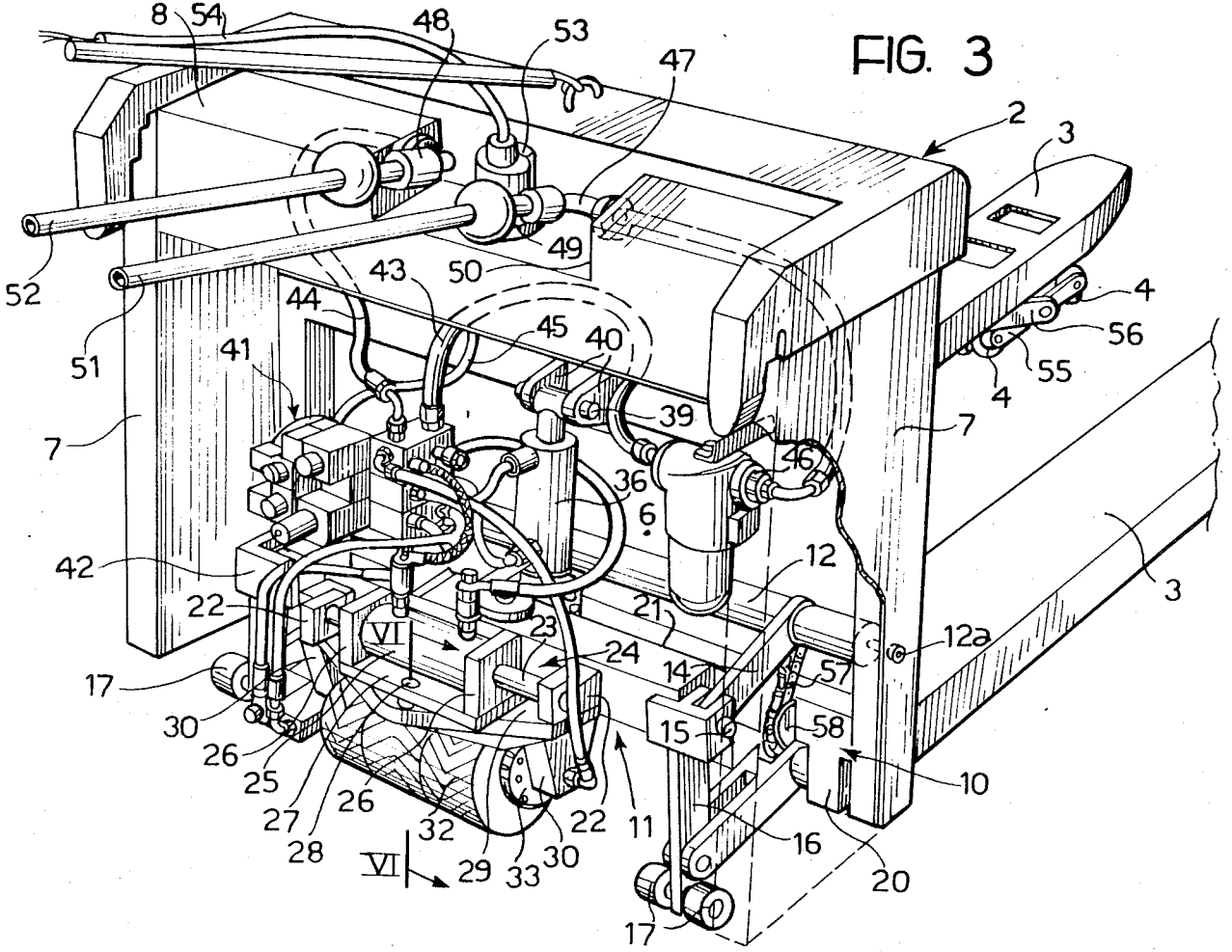
Figure 5:
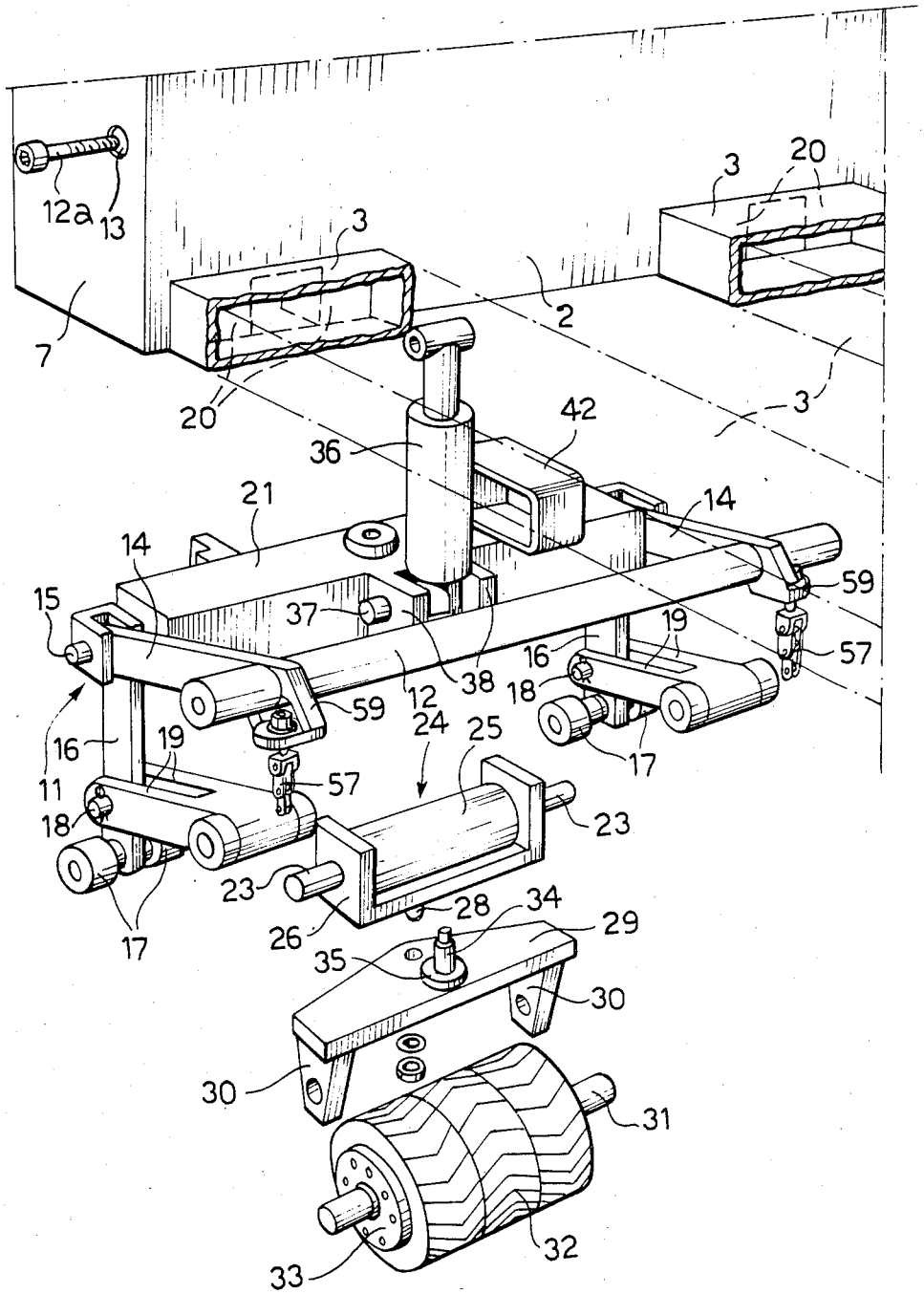

The invention will now be described in detail with reference to the appended drawings, provided purely by way of non-limiting example, in which:

FIG. 1 is a schematic perspective view of a handling vehicle according to the invention illustrated in an operative condition, FIG. 2 is a front perspective view of the vehicle, FIG. 3 is a rear perspective view which shows the inside of the vehicle on an enlarged scale, FIG. 4 is a view similar to FIG. 3 of a component of the vehicle on a reduced scale, FIG. 5 is an exploded front perspective view which shows another component of the vehicle, FIG. 6 is a vertical section taken on the line VI—VI of FIG. 3, on an enlarged scale, and FIG. 7 is a partially sectioned view taken on the line VII—VII of FIG. 2.

With initial reference to FIG. 1, a vehicle according to the invention, generally indicated 1, can be used in conjunction with a conventional lift truck C for the remote handling of loads L. The vehicle 1 can be used to particular advantage for the loading and unloading of loads L. The vehicle 1 can be used to particular advantage for the loading and unloading of loads L relative to a loading platform P of a lorry A by an operator M situated at the controls of the lift truck C, outside the lorry A.

With reference to FIG. 2, the vehicle 1 comprises essentially a generally parallelepipedal rear body 2, from whose front side project two horizontal forks 3 provided at their front ends with lower support wheels or rollers 4, which can be lowered and raised in the manner made clear below.

Two downward-facing hooking prongs 5 project rearwardly from the top of the body 2 and serve in known manner for engagement of the vehicle by a vertically-movable support platform S of the lift truck C.

With reference in greater detail to FIGS. 2 and 3, the body 2 consists, in practice, of a sheet metal box with a vertical front wall 6, two vertical side walls 7 and a horizontal upper wall 8, as well as a vertical rear wall 9 (FIG. 1) which is removable to allow access to the inside of the box.

This box does not have a structural function in practice, since it acts solely as a covering and protective part for the internal mechanism of the vehicle, and is fixed to a strong frame 10 to whose base the two forks 3 are fixed.

A support structure, generally indicated 11 in FIGS. 3 and 5, relative to which the body 2 carrying the forks 3 can be raised and lowered vertically in the manner made clear below, is connected to the frame 10.

The support structure 11 has generally an articulated parallelogram shape formed by a horizontal bar 12 whose ends 12*a* a are articulated at 13 to the sides of the frame 10 of the body 2 and from which two upper arms 14 project. The free ends of the upper arms 14 are articulated at 15 to two respective vertical legs 16 provided with balancing support wheels 17 at their lower ends. Two fork-shaped lower arms 19, are articulated at 18 to the lower regions of the two vertical legs 16 and are themselves articulated to respective attachment parts 20 carried on the lower side of the frame 10 of the body 2.

The support structure 11 also includes a cross member 21 parallel to the horizontal bar 12 and fixed rigidly at its ends to the tops of the vertical legs 16. This cross member 21 has a rectangular section and to its side opposite the vertical wall 6 of the body 2 are fixed two support brackets 22 between which extends horizontally a rod 23 of a double-acting linear hydraulic actuator 24 whose cylinder 25 is axially slidable along the rod 23. The ends of the cylinder 25 are connected to a pair of vertical plates 26 interconnected by a horizontal plate 27 carrying a vertical pin 28 to which a generally triangular lower plate 29 is articulated. This plate 29, which is spaced from the plate 27, carries at its ends two vertical brackets 30 which rotatably support the pin 31 of a roller-like driving and steering wheel 32 incorporating a reversible rotary hydraulic motor 33 of conventional type.

As clearly shown in FIG. 6, the pin 38 is offset with respect to the hydraulic actuator 24 and the plate 29 is articulated to the cross member 21 by means of a vertical pin 34 positioned on the opposite side of the actuator 24 to the pin 28. A thrust bearing 35 coaxial with the pin 34 is interposed between the plate 29 and the lower side of the cross member 21.

A substantially vertical linear actuator, generally indicated 36, is articulated at its lower end, at 37, to an attachment part 38 projecting from the middle region of the side of the cross member 21 facing the vertical wall 6 of the body 2, and at its upper end, at 39, to an attachment 40 fixed in a corresponding position on the upper side of the frame 10.

The horizontal linear actuator 24, the hydraulic motor 33 and the vertical linear actuator 36 are connected by means of respective flexible inlet and outlet hoses to a solenoid control valve unit, generally indicated 41, carried on a support 42 fixed to the upper side of the cross member 21 and connected in turn to a supply hose 43 and a discharge hose 44 for hydraulic fluid, as well as to an electrical supply cable 45. The supply hose 43 leads, through a filter 46 to a respective connection union 47. The discharge hose 44 leads to a respective connection union 48 and the electrical supply cable 45 is connected to a connection socket 49. The unions 47 and 48 and the socket 49 are positioned in a recess 50 in the upper wall 8 of the body 2, and are connected respectively to a flexible supply line 51, a flexible discharge line 52 and a plug 53 connected to an electrical supply cable 54, which unwind from a winding reel V on the lift truck C. The lines 51 and 52 and the cable 54 are connected respectively to a conventional hydraulic unit and a conventional electrical control unit installed on the lift truck C.

As better shown in FIG. 7, the support wheels 4 of the two forks 3 are carried by respective bogies 55, each of which is articulated to a pivoting arm 56 connected at one end to a respective chain 57. The chains 57 pass around respective fixed guides 58 on the frame 10 and are anchored at their opposite ends to attachments 59 carried on the horizontal bar 12. It is clear that, when the fork structure 2 and hence the bar 12 are raised relative to the support structure 11, a downward angular displacement of the arms 56 and hence of the bogies 55 carrying the support wheels 4 occurs. Conversely, when the fork structure 2 and hence the bar 12 are lowered, the arms 56 and hence the bogies 55 are allowed to return to the raised position of FIG. 7.

Instead of the chain drive 57 described above, control of the raising and lowering of the wheels 4 could also be achieved by means of a rigid tie rod, according to the method described and illustrated in the prior patent documents mentioned above.

The operation of the handling vehicle 1 according to the invention is as follows.

During movement to and from the working zone, such as, for example, the loading platform P of the lorry A illustrated, the vehicle 1 is normally carried on the support plate S of the lift truck C by means of the engagement between the hooks 5 and the plate S.

In order to operate remotely in the working zone, the vehicle 1 is first uncoupled from the support plate S and placed on the surface of the working zone, for example on the platform P. At this point, the vehicle 1 can be maneuvered remotely by the operator M at the controls of the lift truck C through the hydraulic lines 51 and 52 and the electrical supply cable 54. Movement of the vehicle 1 is achieved by the action of the hydraulic motor 33 associated with the driving wheel 32, whilst maneuvering is achieved through the steering of the wheel 32 by means of the horizontal linear actuator 24. In effect, displacements of the cylinder 25 in one direction or the opposite direction relative to the shaft 23 cause, through the offset pin 28, corresponding rotations of the plate 29 and hence of the wheel 32 about the axis of the pin 34 and the thrust bearing 35.

The raising and lowering of the forks 3 (which, as stated previously, correspond respectively to the lowering and raising of the support wheels 4) to pick up and put down the loads L is controlled by means of the vertical linear hydraulic actuator 36 whose actuation causes a corresponding displacement of the whole body 2 relative to the cross member 21 and to the vertical legs 16 through the horizontal bar 12 and the upper and lower arms 14, 19 of the support structure 11.

It is clear from the above that, by virtue of the conformation of the support structure 11 and the units for controlling the steering of the driving wheel 32 and the raising of the fork structure 2, the vehicle according to the invention is provided with a simplified and lightened structure which can be manufactured and assembled in a particularly simple and economical manner.

Naturally, the details of construction and forms of embodiment of the vehicle can be varied widely with respect to those described and illustrated, without thereby departing from the scope of the present invention as defined by the following claims.

I claim:

1. A vehicle for the remote handling of loads, comprising a carrying structure provided with a roller-like driving and steering wheel and a fork structure supported by the carrying structure so that it can be raised and lowered, the fork structure having a rear frame and being provided with hook means for connection to a vertically movable attachment part of a lift truck, and electro-hydraulic control means connected to the lift truck being provided for the operation of the driving and steering wheel and the fork structure, a support structure comprising an articulated parallelogram structure including a horizontal bar having its ends articulated to the rear frame of the fork structure, two vertical legs situated on opposite sides of the driving wheel and carrying balancing support wheels at their lower ends, a pair of upper arms carried by the horizontal bar and articulated to the tops of the two vertical legs, and a pair of lower arms articulated at one end to the vertical legs and at their other ends to the rear frame of the fork structure, a cross member parallel to the horizontal bar interconnecting the tops of the vertical legs and carrying the driving wheel underneath it, and a single vertical linear hydraulic actuator for raising and lowering the fork structure relative to the carrying structure being interposed between the middle of the cross member and the rear frame of the fork structure.

2. A vehicle according to claim 1, comprising a horizontal linear hydraulic steering actuator fixed to the cross member and having a movable cylinder, a plate fixed to the said movable cylinder and bearing a vertical pulling pin offset with respect to the actuator, and a forked support articulated to the cross member and carrying the driving wheel, said forked support being rotated by the said pulling pin.

3. A vehicle according to claim 1, wherein the driving wheel incorporates a rotary hydraulic actuator.

4. A vehicle according to claim 1, wherein said fork structure comprises forks which are provided with respective lower support wheels which can be lowered and raised by the respective raising and lowering of the fork structure, and a chain drive anchored at one end to the horizontal bar of the support structure and at the opposite end to respective pivoted supports carrying the support wheels for raising and lowering the said support wheels.

5. A vehicle for the remote handling of loads, comprising a carrying structure provided with a roller-like driving and steering wheel and a fork structure supported by the carrying structure so that it can be raised and lowered, the fork structure having a rear frame and being provided with hook means for connection to a vertically movable attachment part of a lift truck, and electro-hydraulic control means connected to the lift truck being provided for the operation of the driving and steering wheel and the fork structure, a support structure having a generally articulated parallelogram shape and including a horizontal bar having its ends articulated to the rear frame of the fork structure, two vertical legs situated on opposite sides of the driving wheel and carrying balancing support wheels at their lower ends, a pair of upper arms carried by the horizontal bar and articulated to the tops of the two vertical legs, and a pair of fork-shaped lower arms articulated at one end to a lower portion of the vertical legs and at their other ends to the rear frame of the fork structure, a cross member positioned and rigidly fixed parallel to the horizontal bar for interconnecting the tops of the vertical legs mounted above the driving and steering wheel, the cross member having a generally rectangular section with two fixed support brackets between which a rod extends horizontally, a horizontal linear hydraulic steering actuator having a cylinder mounted upon said rod which cylinder can movably slide axially therealong, vertical plates fixed to each end of said movable steering cylinder and bearing a vertical pulling pin offset with respect to the actuator, and a forked support articulated to the cross member and carrying the driving and steering wheel, said forked support being rotated by the said pulling pin; and a single vertical linear hydraulic actuator for raising and lowering the fork structure relative to the carrying structure being interposed between the middle of the cross member and the rear frame of the fork structure.

6. A vehicle according to claim 5 wherein the vertical plates of the steering cylinder are interconnected by a horizontal plate carrying said vertical pulling pin, and further wherein a lower articulated plate member is provided beneath said pin with a thrust bearing which is coaxial with said pin interposed between said pin and said lower plate member.

7. A vehicle according to claim 5, wherein the driving wheel incorporates a rotary hydraulic actuator.

8. A vehicle according to claim 5, wherein the forks are provided with respective lower support wheels which can be lowered and raised by the respective raising and lowering of the fork structure, and a chain drive anchored at one end to the horizontal bar of the support structure and at the opposite end to respective pivoted supports carrying the support wheels for raising and lowering the said support wheels.

9. A vehicle for the remote handling of loads, comprising a carrying structure provided with a roller-like driving and steering wheel and a fork structure supported by the carrying structure so that it can be raised and lowered, the fork structure including a pair of forks provided with respective lower support wheels which can be lowered and raised by the respective raising and lowering of the fork structure, said fork structure having a rear frame and being provided with hook means for connection to a vertically movable attachment part of a lift truck, and electro-hydraulic control means connected to the lift truck being provided for the operation of the driving and steering wheel and the fork structure, a support structure consisting essentially of a generally articulated parallelogram shape and including a horizontal bar having its ends articulated to the rear frame of the fork structure, two vertical legs situated on opposite sides of the driving wheel and carrying balancing support wheels at their lower ends, a pair of upper arms carried by the horizontal bar and articulated to the tops of the two vertical legs, and a pair of fork-shaped lower arms articulated at one end to a lower portion of the vertical legs and at their other ends to the rear frame of the fork structure, a cross member positioned and rigidly fixed parallel to the horizontal bar for interconnecting the tops of the vertical legs mounted above the driving and steering wheel, wherein the driving and steering wheel incorporates a rotary hydraulic actuator, the cross member having a generally rectangular section with two fixed support brackets between which a rod extends horizontally, a horizontal linear hydraulic steering actuator having a cylinder mounted upon said rod which cylinder can movably slide axially therealong, vertical plates fixed to each end of said movable steering cylinder and bearing a vertical pulling pin offset with respect to the actuator, and a forked support articulated to the cross member and carrying the driving and steering wheel, said forked support being rotated by the said pulling pin, wherein the vertical plates of the steering cylinder are interconnected by a horizontal plate carrying said vertical pulling pin, and further wherein a lower articulated plate member is provided beneath said pin with a thrust bearing which is coaxial with said pin interposed between said pin and said lower plate member; and a single vertical linear hydraulic actuator for raising and lowering the fork structure relative to the carrying structure being interposed between the middle of the cross member and the rear frame of the fork structure.

* * * * *